US006139357A

United States Patent [19]

Shih

[11] Patent Number: 6,139,357

[45] Date of Patent: Oct. 31, 2000

[54] CABLE CONNECTOR FOR CONNECTING A SIGNAL LINE TO A PRINTED CIRCUIT BOARD AND CARD

[75] Inventor: David Shih, Hsinchu, Taiwan

[73] Assignee: 3 View Technology Co., Ltd., Hsinchu, Taiwan

[21] Appl. No.: 09/111,879

[22] Filed: Jul. 8, 1998

[51] Int. Cl.[7] ..... H01R 12/24

[52] U.S. Cl. ..... 439/493; 439/76; 439/76.1

[58] Field of Search ..... 439/77, 493, 761, 439/492, 76.1, 449, 946

[56] References Cited

U.S. PATENT DOCUMENTS

| | | | |
|---|---|---|---|
| 4,894,015 | 1/1990 | Stockero et al. | 439/67 |
| 5,192,833 | 3/1993 | Gibson | 174/74 |
| 5,242,310 | 9/1993 | Leung | 439/76 |
| 5,330,360 | 7/1994 | Marsh et al. | 439/76 |
| 5,667,390 | 9/1997 | Keng | 439/76.1 |
| 5,777,855 | 7/1998 | Yokajty | 361/803 |
| 5,802,711 | 9/1998 | Card et al. | 29/840 |
| 6,004,145 | 12/1999 | Gasparovic et al. | 439/76.1 |

*Primary Examiner*—Brian Sircus
*Assistant Examiner*—Michael C. Zarroli
*Attorney, Agent, or Firm*—Thomas, Kayden, Horstemeyer & Risley

[57] ABSTRACT

A cable connector for the usual on-line computer peripheral interface card such as PCMCIA card or COMPACT FLASH card, comprising a main body portion and a connecting head outside which a substantially rigid pin is exposed. The main body portion and the connecting head being fixed together and directly disposed in a notch preset on an interface card to fix both the body portion and the interface card together by fixing the pin directly on a solder pad disposed on the circuit board. The main body portion being arranged and configured to receive a portion of a signal line, the fixing of the main body portion to the connecting head facilitating communication between the signal line and the pin.

19 Claims, 5 Drawing Sheets

CABLE CONNECTOR FOR CONNECTING A SIGNAL LINE TO A PRINTED CIRCUIT BOARD AND CARD

FIELD OF THE INVENTION

The present invention is related to a cable connector for the computer peripheral interface card.

BACKGROUND OF THE INVENTION

The interface card in general for connecting the computer to offer a preset function may be approximately divided into two categories. One function category is used for the PCMCIA card of a portable computer in general, referred to as PC card; another category is used for the COMPACT FLASH card of the palmtop computer, referred to as CF card. The function of the foregoing two interface cards is the same and they are well-known computer peripheral interface cards but their volumes are different. The volume of PC card is larger for the portable computer, and the smaller volume CF card is for the palmtop computer. However, regardless of PC card or CF card, when disposed on the computer for use, its terminal is extended to connect a signal line of which the front end is provided with a connector. The signal line is connected through the connector to the circuit board in PC or CF card so as to achieve a state of communication and connection and further to perform the functional operation thereof.

The conventional connecting method of PC card or CF card and connector as shown in FIG. 1 is an insert-extract combination. The CF card 10 is provided with a female seat connecting head 101 (as shown by CF card in the drawings) disposed in a suitable position on the inner side of CF card 10 and fixed therein. Another end of the head 101 is connected to a connector 20 at the front end of a signal line 22. The connector 20 consists of a male seat connecting head 21 in corresponding cooperation with the female seat connecting head 101. The signal line 22 is connected to the rear end of the connector 20 to offer signals. This insert type connecting head 21 design results in at least two separate parts. Therefore, a user must remember to have all parts with them to proceed with on-line use. However, with an insert type connecting head 21, both the card 10 and the signal line 22 may be disengaged from each other or damaged by the user's pull or other foreign factors at times during use. Furthermore, the manufacturing process of an insert type connecting head 21 is generally somewhat costly and laborious.

FIG. 2 is an optional view of the structure of a conventional connector wherein the connector 30 is essentially used for PC card 11 not having a female seat connecting head. A plurality of signal bare wires 301 extend from one end of the connector 30 and are wrapped by a rubber block 302. The rubber block 302 is arranged and configured to be partially disposed in the card 11. In this arrangement the connector 30 has no hard substance as a support and the rubber substance is rather soft. As such, pulling with an undue force can break the connector 30 or crack both the connector 30 and the rubber block 302. A plurality of signal bare wires 301 extended from the front end of the connector 30. The wires 301 are welded one by one in welding holes 41 disposed on the circuit board 40 in the PC card 11. In this arrangement a plurality of welding holes 41 are arranged and configured to substantially correspond to the wires 301. As such, sufficient space must be reserved on the circuit board 40 resulting in significant wasted space. Advantageously, this connection arrangement does result in an integrally connected single member to be implemented in on-line operation. However, such a connecting arrangement requires that a portion of the connector 30 be disposed in the PC card 11. Additionally, the process of wire connecting by welding in a cost effective manner dictates that the area in the PC card 11 must be substantially large, therefore rendering this connection not applicable to the smaller volume CF card. Therefore, this type of connection is somewhat limited in its application. Individual welding of each wire 301 to a hole 41 is laborious and therefore, cost ineffective. Furthermore, the rubber block 302 made of soft and fragile substance can be broken and cracked by the user's pull or through prolonged use. The breakdown of the rubber block 302 can lead to breaking the signal bare wires 301, thereby rendering the card nonfunctional.

It can be seen that there is a need for a connector applicable to both PC and CF card applications that is capable of maintaining the desired volume of the PC or CF card while being user friendly and cost effective to manufacture.

SUMMARY OF THE INVENTION

The primary object of the present invention is to offer a cable connector applicable to a plurality of computer peripheral interface cards. One embodiment of the preferred connector comprises a main body portion wrapped with rubber or plastic substance preferably through extrusion moulding. A signal line is preferably received toward a receiving end of the main body portion and a pin preferably extends from a fixing end portion of the main body portion such that the pin is outside a wrapping layer. The preferred pin can be disposed in an interface card, and directly fixed on a solder pad disposed on the circuit board thereby completing the required connection. The area required by the preferred solder pad on the circuit board is substantially less than that required of conventional welding holes. As such, the preferred connector of the present invention can be used for the smaller volume CF card.

Another object of the present invention is to provide a cable connector having a lower volume and cost. A connecting head of the connector is directly wrapped with a layer of rubber or plastic. A pin extending from the connecting card can be disposed in the interface card, and the pin directly fixed on a corresponding solder pad of the circuit board. As such, joining the male and female connecting heads is eliminated thereby simplifying the connector, reducing volume, reducing materials and lowering cost.

Other features and advantages of the present invention will become apparent to one of reasonable skill in the art upon examination of the following drawings and detailed description. It is intended that all such additional objects, features, and advantages be included herein within the scope of the present invention, as defined by the claims.

DETAILED DESCRIPTION OF THE INVENTION

Figure 1:
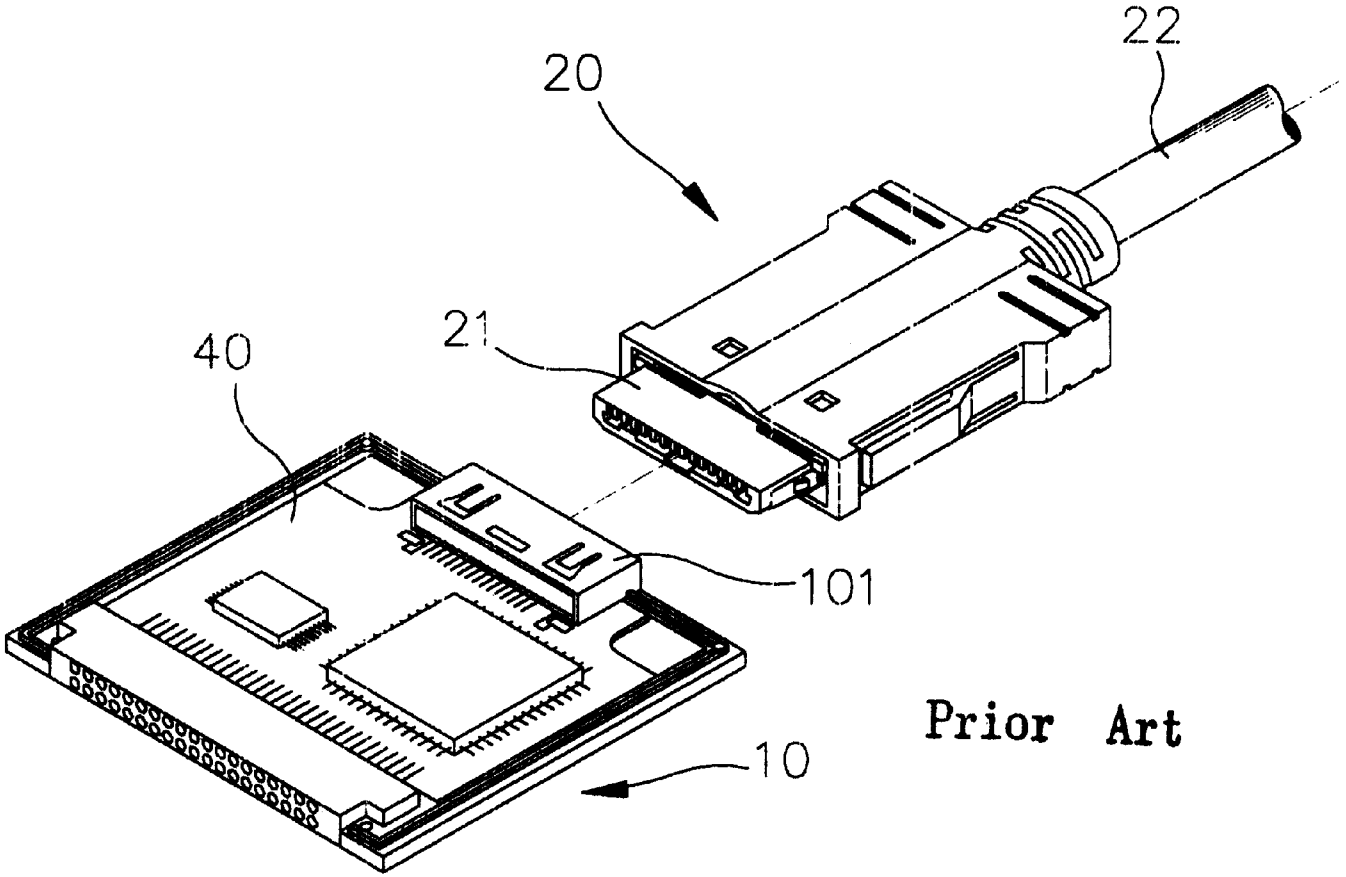
Prior Art FIG. 1
FIG. 1 shows the structure of a conventional connector.
Figure 2:
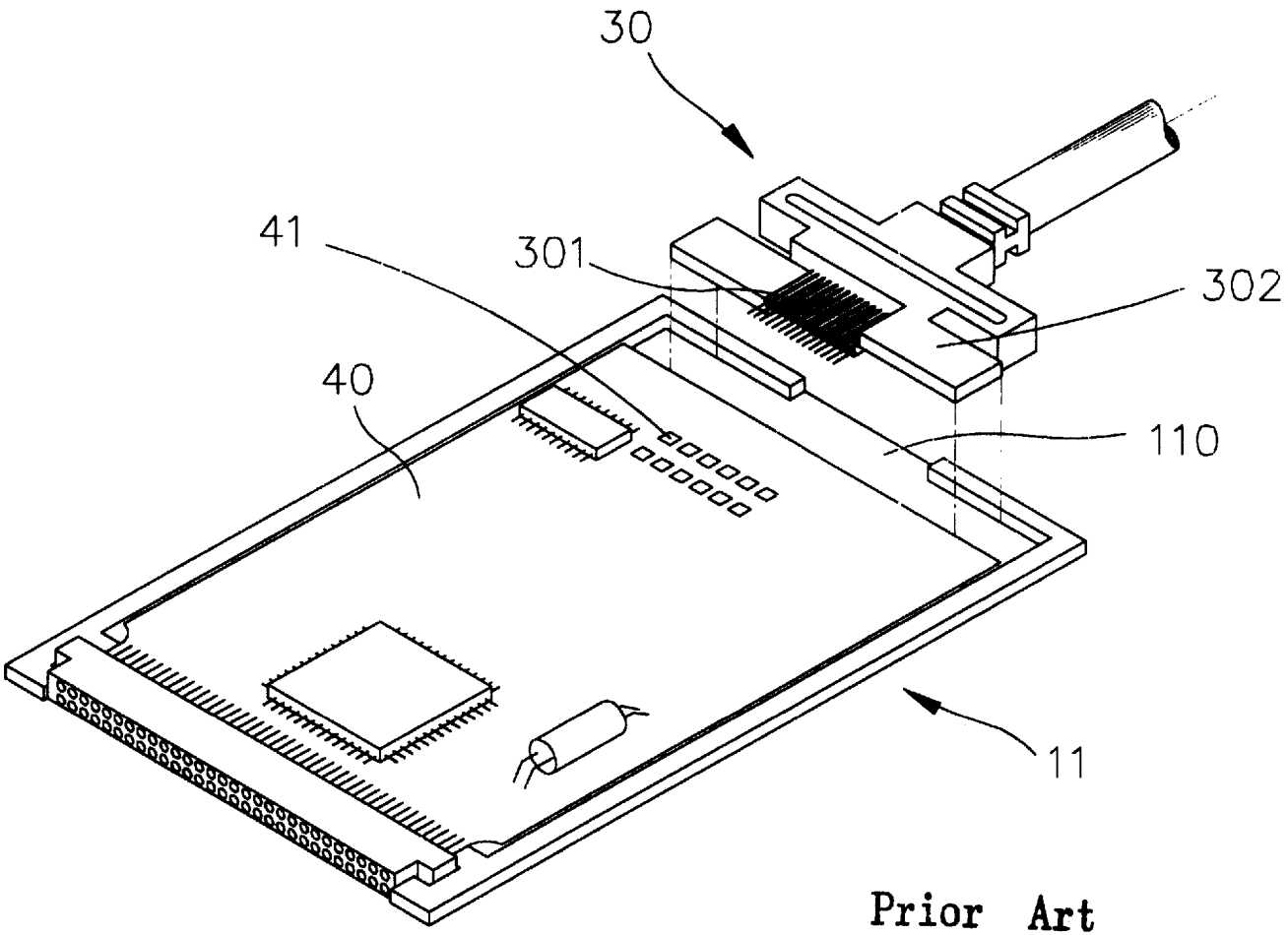
Prior Art FIG. 2
FIG. 2 shows the structure of another embodiment of a conventional connector.
Figure 3:
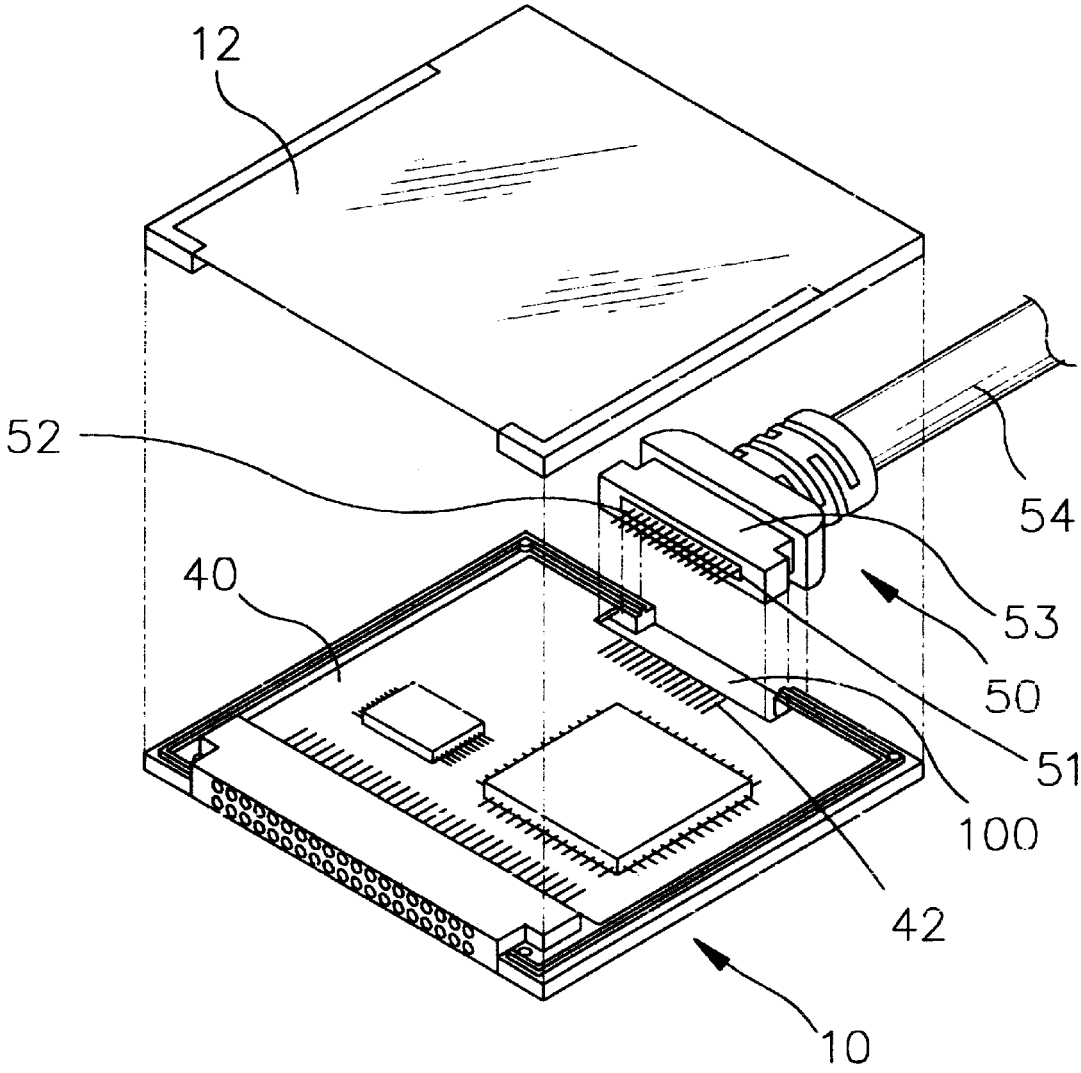
FIG. 3 illustrates a partially exploded perspective view of a preferred connector structure of the present invention.

The objects, characteristics and functions of the present invention can be best described in detail in conjunction with the preferred embodiment and accompanying drawings as follows:

As shown in FIG. 3, a connector 50 can be applied to the usual computer peripheral interface card (such as PC or CF card). The connector 50 comprises a main body portion 53 which wraps and receives a signal line 54 toward a receiving end of the body portion 53. A fixing end of the body portion 53 wraps a connecting head 51 from which a pin 52 extends and is exposed outside the body portion 53. When manufacturing the connector 50, the connecting head 51 is wrapped with a main body 53 which can comprise ABS, LCP, PBT or PVC such that the pin 52 is exposed outside the body portion 53. The body portion 53 can preferably comprise a substantially I-shaped member in favor of being disposed in the CF card 10 (or PC card). The card 10 preferably includes a notch 100 toward one end thereof. The pin 52 exposed toward the fixing end of the connector 50, can be disposed on the solder pad 42 of the circuit board 40 in the card 10. The pin 52 can be fixed to the solder pad 42 through soldering, or any suitable means, thereby finishing the connection.

Figure 4:
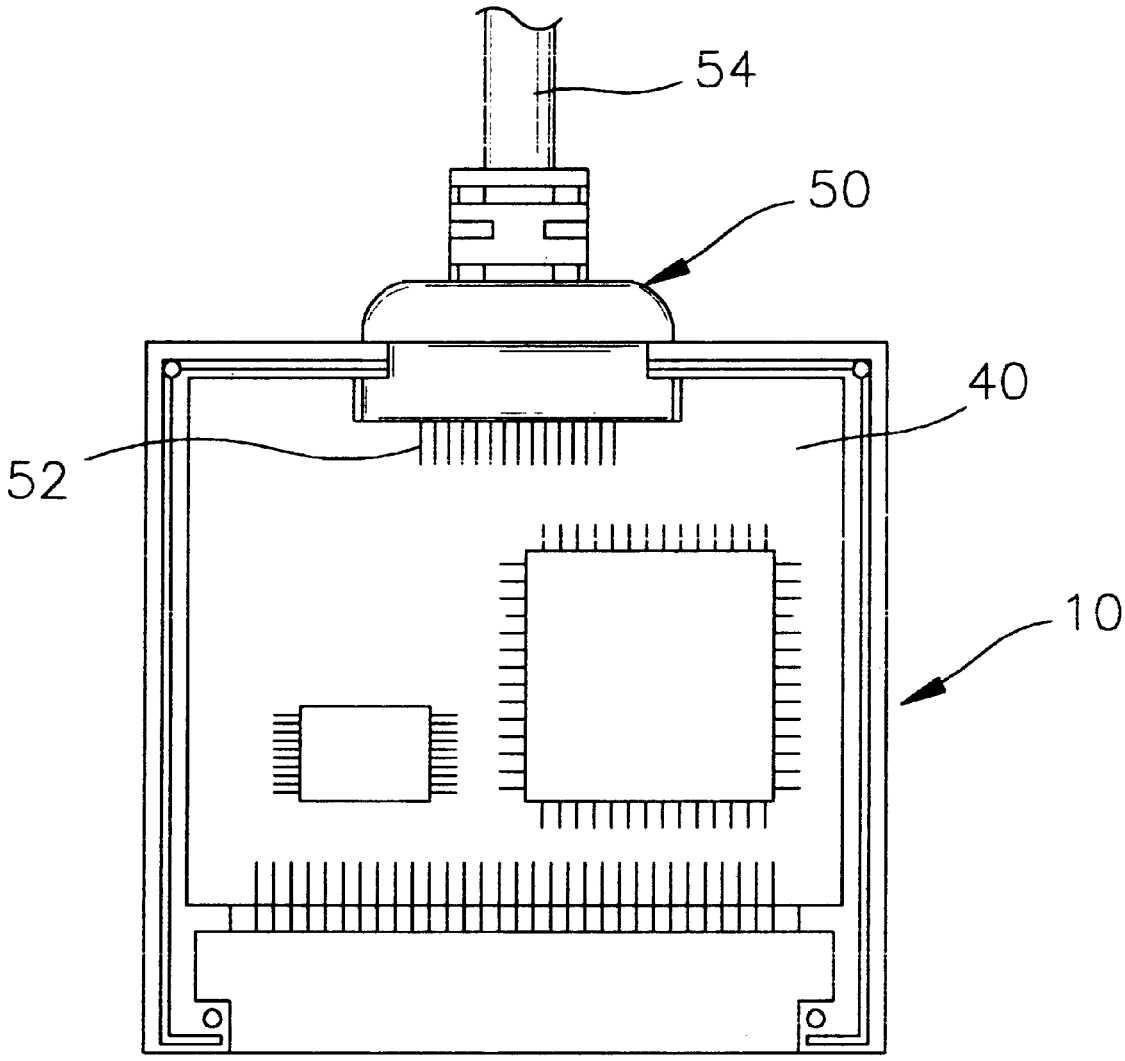
FIG. 4 illustrates a plan view of the assembly of the present invention.
Figure 5:
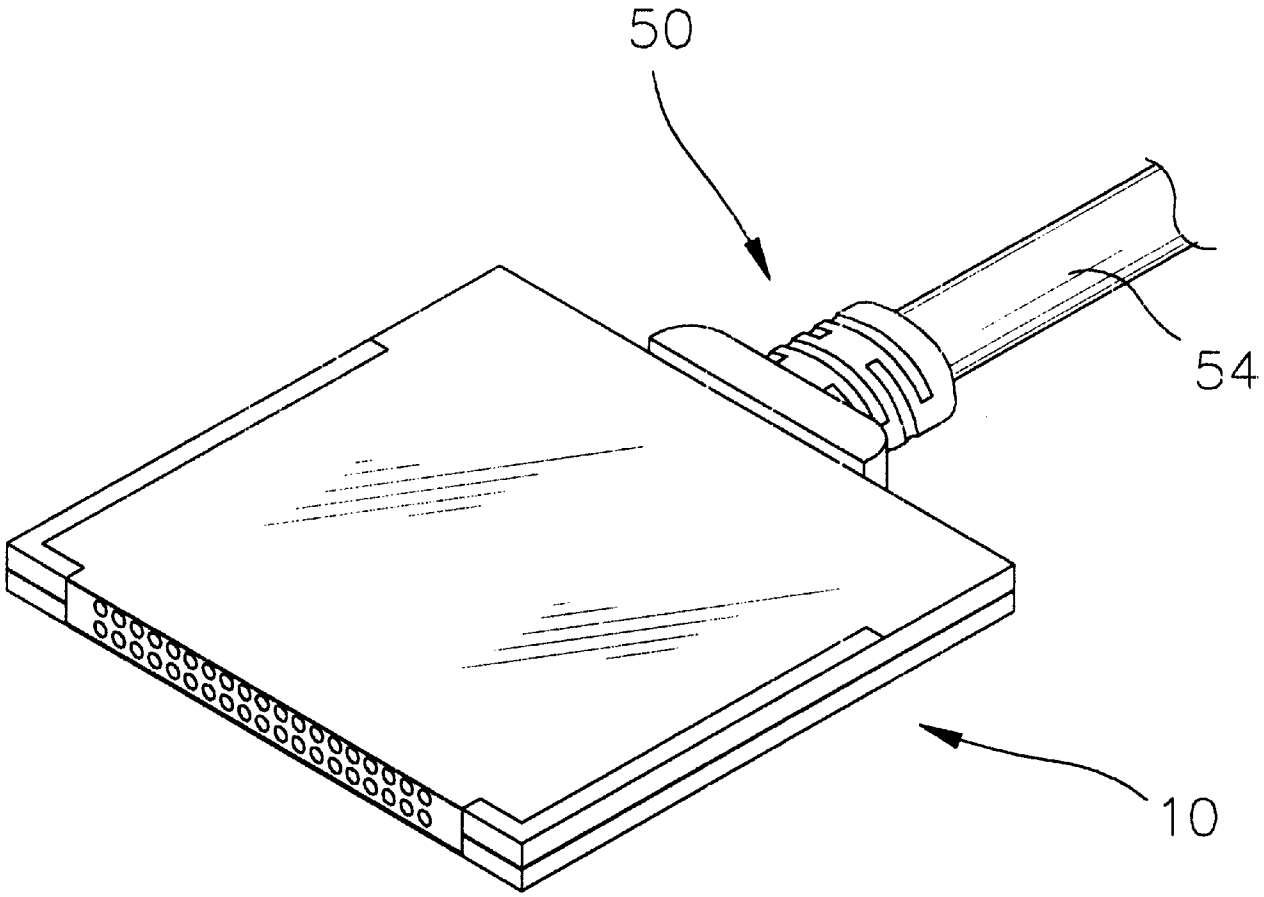
FIG. 5 illustrates a perspective view of a finished assembly of the present invention.

As shown in FIG. 4 and 3, the preferred body portion 53 comprises a substantially I-shaped member. As such a portion of the connector 50 can be disposed at the notch 100 such that a recessed portion of I-shaped connector 50 tightly catches the notch 100 thereby stably fixing the connector 50 thereon. The card 10 can then be covered with the upper cover 12 to finish assembly thereof as shown in FIG. 5. Upon the connector 50 being fixed in the card 10 the fixing end of the body portion 53 is disposed between the card 10 and the upper cover 12. The pin 52 is exposed outside of the main body portion 53. As such, the volume of the main body portion 53 can be reduced without impacting the size of the pin 52. This connector 50 configuration eliminates the use of the conventional male and female seat connecting heads resulting in manufacturing cost savings. Furthermore, the connector 50 configuration of the present invention does not require a card 10 of large area, thereby resulting in a connector 50 applicable to a PC or CF card, or the like. In addition, the connecting head 51 preferably comprises a substantially hard rigid material capable of acting as a support to the connector 50. The body portion 53 preferably contributes to stability and durableness of the connector 50.

The cable connector 50 of the present invention is fixed as a single member to the interface card 10 to which it is connected. As such, the connector 50 is convenient to carry without the trouble of forgetting to bring a certain member.

It should be emphasized that the above described embodiments of the present invention, particularly any "preferred" embodiments, are merely possible examples of implementations, merely set forth for a clear understanding of the principles of the invention. Many variations and modifications may be made to the above described embodiments(s) of the invention without departing substantially from the spirit and principles of the invention. All such modifications and variations are intended to be included herein within the scope of the present invention.

What is claimed is:

1. A cable connector system for connecting a signal line to a printed circuit board, the system comprising:

a main portion having a receiving end, said receiving end receiving a portion of the signal line;

a connecting head being fixed on said main body portion toward the fixing end;

a pin, substantially rigid and extending from said connecting head, said pin in fixed communication with said signal line internal to the cable connector through the fixed connection of said connecting head to said main body portion;

a card, adapted to receive the printed circuit board, wherein said pin being soldered directly to the card, and said signal line extending from said card along an axis of said card.

2. The cable connector of claim 1, wherein the card further comprises:

a notch, said notch receiving said main portion of said connector;

a solder pad, said solder pad receiving said pin, wherein said pin is soldered to said solder pad such that said pin is substantially flush with said card.

3. The cable connector of claim 1, the system further comprises an upper cover, wherein said card receives said upper cover, such that said upper cover covers said printed circuit board and said pin soldered to said solder pad.

4. The cable connector of claim 1, wherein said main body portion is substantially rigid.

5. The cable connector of claim 1, wherein said main body portion comprises plastic.

6. The cable connector of claim 1, wherein said main body portion comprises ABS.

7. The cable connector of claim 1, wherein said main body portion comprises LCP.

8. The cable connector of claim 1, wherein said main body portion comprises PBT.

9. The cable connector of claim 1, wherein said main body portion comprises PVC.

10. The cable connector of claim 1, wherein said main body portion comprises a substantially I-shaped member.

11. A cable connection between a signal line and a printed circuit board comprising:

a connector;

a card that receives said connector;

said connector comprising:

a main body portion having a receiving end and a fixing end, said receiving end being arranged and configured to receive a portion of the signal line;

a connecting head being fixed on said main body portion toward said fixing end;

a pin being substantially rigid and extending from said connecting head, said pin being in fixed communication with said signal line internal to the cable connector through the fixed connection of said connecting head to said main body portion;

said card adapted to receive the printed circuit board, said card comprising:

a notch disposed therein, said notch having a portion of said connector seated therein;

a solder pad, said solder pad having a portion of said pin fixed thereon; and an upper cover, said upper cover being disposed on said card such that the printed circuit board, said pin, and said solder pad are covered.

12. The cable connection of claim 11, wherein said main body portion is substantially rigid.

13. The cable connection of claim 11, wherein said main body portion comprises plastic.

14. The cable connection of claim 11, wherein said main body portion comprises ABS.

15. The cable connection of claim 11, wherein said main body portion comprises LCP.

16. The cable connection of claim 11, wherein said main body portion comprises PBT.

17. The cable connection of claim 11, wherein said main body portion comprises PVC.

18. The cable connection of claim 11, wherein said main body portion is substantially I-shaped.

19. The cable connection of claim 11, wherein said pin is fixed to said solder pad with solder.

* * * * *